US011229092B2

(12) United States Patent
Lomp et al.

(10) Patent No.: US 11,229,092 B2
(45) Date of Patent: Jan. 18, 2022

(54) HEATING CIRCUIT AND INDUCTION COOKING HOB

(71) Applicant: E.G.O. Elektro-Geraetebau GmbH, Oberderdingen (DE)

(72) Inventors: Stephane Lomp, Oberderdingen (DE); Steffen Lang, Oberderdingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 584 days.

(21) Appl. No.: 15/381,715

(22) Filed: Dec. 16, 2016

(65) Prior Publication Data

US 2017/0181229 A1 Jun. 22, 2017

(30) Foreign Application Priority Data

Dec. 18, 2015 (EP) ..... 15201258

(51) Int. Cl.
*H05B 6/06* (2006.01)
*H05B 6/12* (2006.01)

(52) U.S. Cl.
CPC ..... *H05B 6/065* (2013.01); *H05B 6/062* (2013.01); *H05B 6/1272* (2013.01)

(58) Field of Classification Search
CPC ..... H05B 6/065; H05B 6/062; H05B 6/1272
USPC ..... 219/620
See application file for complete search history.

(56) References Cited

U.S. PATENT DOCUMENTS 7,504,607 B2 * 3/2009 Barragan Perez ..... H02M 1/44 219/624
9,537,422 B2 1/2017 Kawato
2012/0103971 A1 * 5/2012 Oh ..... H05B 6/062 219/465.1
2012/0268221 A1 * 10/2012 Czimmek ..... F02M 53/06 331/117 R
2012/0321761 A1 * 12/2012 De la Cuerda Ortin ..... H05B 6/062 426/231
2013/0265810 A1 * 10/2013 Kawato ..... H05H 1/46 363/131
2014/0183184 A1 7/2014 Oh et al.
(Continued)

FOREIGN PATENT DOCUMENTS

CN 202818656 U 3/2013
CN 103348765 A 10/2013
CN 203661322 U 6/2014
(Continued)

OTHER PUBLICATIONS

Machine translation of DE102012204250 perfomed on Jun. 27, 2019.*
(Continued)

*Primary Examiner* — Tu B Hoang
*Assistant Examiner* — Alba T Rosario-Aponte
(74) *Attorney, Agent, or Firm* — Alston & Bird LLP

(57) ABSTRACT

The invention relates to a heating circuit for induction heating coils of an induction cooking hob and to an induction cooking hob including such a heating circuit. In the heating circuit, there are in each case two auxiliary half bridges interconnected to excite a respective resonant circuit for an induction heating coil such that the resonant circuit is excited by a full bridge. Thereby, lost heat is considerably reduced. Via a connecting device the auxiliary half bridges can be controlled to excite induction heating coils, which are partly or fully covered by a cooking vessel.

13 Claims, 7 Drawing Sheets

(56) References Cited

U.S. PATENT DOCUMENTS

| | | | | |
|---|---|---|---|---|
| 2016/0029439 | A1* | 1/2016 | Kurose | H05B 6/065 219/626 |
| 2016/0323937 | A1* | 11/2016 | Anton Falcon | H05B 6/062 |

FOREIGN PATENT DOCUMENTS

| | | | |
|---|---|---|---|
| DE | 102012204250 | A1 * | 10/2012 |
| DE | 102012218284 | A1 * | 4/2014 |
| EP | 2170010 | A2 | 3/2010 |
| EP | 2661152 | A1 | 11/2013 |
| EP | 2753145 | A2 | 7/2014 |
| EP | 2760251 | A1 | 7/2014 |
| JP | S 58-038015 | A | 3/1983 |
| JP | S 58-042194 | A | 3/1983 |
| JP | S 59-144796 | U | 9/1984 |
| JP | 2008-293871 | A | 12/2008 |
| JP | 43-66413 | B2 | 11/2009 |
| JP | WO 2012/039035 | A1 | 2/2014 |
| WO | WO 2008/031560 | A1 | 3/2008 |
| WO | WO 2013/042288 | A1 | 3/2013 |
| WO | WO 2014/167814 | A1 | 10/2014 |

OTHER PUBLICATIONS

Machine translation of DE 102012218284 performed on Jun. 27, 2019.*

National Intellectual Property Administration, Office Action, including Search Report, received for Application No. 201611165966.6, dated Sep. 15, 2020, 28 pages, P.R.C.

Japan Patent Office, Notice of Reason for Rejection received for Application No. 2016-228833, dated Oct. 30, 2020, 10 pages, Japan.

* cited by examiner

HEATING CIRCUIT AND INDUCTION COOKING HOB

CROSS-REFERENCE TO RELATED APPLICATIONS

This application claims priority to European Application No. 15201258.9, filed Dec. 18, 2015, the contents of which are hereby incorporated herein in its entirety by reference.

TECHNOLOGICAL FIELD

The invention relates to a heating circuit for induction heating coils of an induction cooking hob and to an induction cooking hob including such a heating circuit.

BACKGROUND

Power control of an induction cooking zone in an induction heating system, which typically has a plurality of induction cooking zones as an induction hob, is usually performed by controlling a provided series resonant circuit by means of variable frequency, or variable voltage, or a combination of variable frequency and variable voltage. With implementations well-known in the prior art, exclusively half-bridge topology is employed for reasons of cost efficiency.

Typically therein, each resonant circuit is controlled respectively by one converter in half-bridge topology. This allows an individual and continuous adjusting of the output power per cooking zone, wherein the cooking zones are also referred to simply as "zones". Such zones may be, for example, in a circular, rectangular, trapezoidal or octagonal shape.

With so-called flat cooking systems zones are designed and arranged such that the user is no longer compelled to assign the cooking vessel to a single zone, but the vessel is detected discretely by the system according to the position of placement, and in case of covering or overlapping of a plurality of zones, there is an automatic interconnecti4881on of zones to one a common cooking zone effected. Thereby, for example, two initially individual zones can be operated like one single zone, wherein each zone typically has its own converter and resonant circuit.

An important drawback of solution approach is the cost, since in this case for each zone, i.e., for any smallest controllable unit, a distinct converter is provided. Each converter has essentially two power semiconductors in half-bridge topology, typically IBGT-Transistors, and a bridge driver or any other control IC. Such components are expensive and increase system cost considerably.

Furthermore, it was found that with implementations according to the prior art, high power losses do occur. As a result, there is increased power demand and need for using particularly temperature-resistant components and/or providing of cooling devices, which will likewise increase system cost.

BRIEF SUMMARY

The invention is based on the problem to provide a heating circuit mentioned above and an induction cooking hob mentioned above including such a heating circuit, with which problems of the prior art can be solved and it is in particular possible to provide a heating circuit and an induction cooking hob with such a heating circuit whereby costs and/or energy consumption are optimized.

This problem is solved by means of a heating circuit and by means of an induction cooking hob, which is provided therewith. Advantageous and preferred refinements of the invention are the subject matter of the further claims and are explained in more detail below. In this context, many of the features are specified or described only for the heating circuit or only for the induction cooking hob. However, independently of this they are intended to be able to apply both to the heating circuit and to the induction cooking hob independently. The wording of the claims is made into the content of the description by express reference.

A heating circuit for induction heating coils of an induction cooking hob is provided, which includes a reference half bridge. It has a plurality of resonant circuits, each having a first terminal and a second terminal, wherein an induction heating coil is arranged in each resonant circuit. The induction heating coils are in particular for heating of cooking vessels in well-known manner. The resonant circuits can in particular be series resonant circuits.

The heating circuit includes a plurality of auxiliary half bridges. Furthermore, the heating circuit includes a connecting device.

All first terminals of the resonant circuits are coupled to the reference half bridge. Thus, the reference half bridge can, in general, be used for controlling any of the resonant circuits.

Each second terminal of a respective resonant circuit is coupled to the connecting device. The connecting device is configured to connect a number of the coupled resonant circuits selectively to a respective one of the auxiliary half bridges such that each resonant circuit connected to an auxiliary half bridge is excitable by a full bridge composed of the auxiliary half bridge and the reference half bridge.

In the heating circuit according to the invention, a respective resonant circuit is excited not only by a half bridge, but by a full bridge. As a result, the thermal stress of the individual components is significantly reduced by the distribution to more components, there is an overall reduction in energy consumption, and there is less effort needed due to excessively high temperature of the heating circuit per se. Furthermore, with corresponding design of the connecting device, separate switchability of a plurality of resonant circuits can be reached by selective connecting, without need of a distinct half bridge existing for each resonant circuit. Thereby, the requirement of components and, thus, complexity and costs are reduced.

According to an embodiment, the connecting device fixedly connects each resonant circuit to exactly one auxiliary half bridge. In such an embodiment, the advantage obtained by using a full bridge is achieved without any switchability of the connecting device being provided. This corresponds to a simple embodiment which can be employed in particular with a low number of resonant circuits.

According to an embodiment, the connecting device is switchable. This allows in particular controlling of a plurality of resonant circuits, wherein the number of present auxiliary half bridges can be less than the number of resonant circuits and, all the same, individual controllability of the resonant circuits is ensured. The connecting device can be switchable, for example, in response to signals of a control device or an operator panel.

The connecting device can be provided with a number of switches, wherein each switch in the closed condition connects exactly one resonant circuit assigned thereto to exactly one auxiliary half bridge. What is allowed thereby is selective controlling of resonant circuits, in particular of more resonant circuits than auxiliary half bridges present. The switches can preferably be relays, however, other embodiments such as transistors, for example, are also possible.

According to an embodiment, a first resonant circuit is assigned to exactly one first switch, and a second resonant circuit is assigned to exactly one second switch, wherein the first switch and the second switch, in the respectively closed condition, make connection to different auxiliary half bridges. The embodiment is based on the finding that it is sufficient for typically two resonant circuits of an induction cooking hob to be connected to one or to none of the auxiliary half bridges, such that the respective resonant circuit can be controlled only by one auxiliary half bridge, but not by any other auxiliary half bridge present. Indeed, in view of functionality, connectability even to another auxiliary half bridge would not be detrimental, however, complexity and, thus, expenses would be increasing thereby. The first and the second resonant circuits can in particular be resonant circuits on the peripheral side, i.e., resonant circuits with the other resonant circuits of the heating circuit arranged between them.

According to a preferred embodiment, a number of resonant circuits are each assigned a plurality of switches, wherein the switches assigned to a respective resonant circuit, in a respectively closed condition, connect the resonant circuit to different auxiliary half bridges. This allows control of the resonant circuits by different auxiliary half bridges. Thus, for controlling the respective resonant circuit, there is no predefinition to a specific auxiliary half bridge. The resonant circuits can in particular be those resonant circuits that are not the above mentioned first resonant circuit and second resonant circuit. In other words, typically the resonant circuits are those that are not on the peripheral side, i.e., that are arranged between the first resonant circuit and the second resonant circuit.

According to a preferred embodiment, the heating circuit includes four resonant circuits. Further preferred is that the heating circuit includes two auxiliary half bridges. Especially the combination has proved to be advantageous, since an optimum utilization of the power potential provided by a typical, 16 A fused, domestic mains connection is obtained. Should more induction heating coils be intended, the heating circuit can include correspondingly more resonant circuits, and typically a higher fuse is also provided therein, or there can even a plurality of such heating circuits be used in parallel.

The resonant circuits are preferably series resonant circuits. This has proved advantageous for typical applications in an induction cooking hob.

Preferably, each auxiliary half bridge and the switching means thereof, respectively, has an assigned magnetic transformer for controlling. Such a magnetic transformer has proved to be a cost-efficient and, nonetheless, reliable and appropriate alternative as compared to half-bridge drivers well-known in the prior art.

Preferably, all of the induction heating coils, and in particular also the auxiliary half bridges, are of identical design. This allows simple implementation.

Preferably, each induction heating coil has an assigned current converter for measuring and regulating, respectively, of the power of the induction heating coils. Such a current converter can in particular measure the current flowing through a respective induction heating coil, and supply the information obtained therefrom to a controller unit, like a microcontroller, for example. This allows a particularly fine and rapid power adjustment.

According to an advanced embodiment, the heating circuit is arranged to perform power adjustment by phase shifting of bridge voltages. This allows a simple and advantageous adjustment of the respective power.

The invention furthermore relates to an induction cooking hob, comprising a cooktop hotplate, and at least one heating circuit according to the invention. In that context, there may be resort to any above described embodiments and variants. Each resonant circuit of the heating circuit includes a respective induction heating coil which is arranged underneath the cooktop hotplate for establishing a cooking zone.

The induction cooking hob according to the invention allows achievement of the above mentioned advantages for an induction cooking hob as described with reference to the heating circuit according to the invention.

The induction cooking hob preferably includes a control which is arranged to control the auxiliary half bridges and/or the connecting device. Thereby, different configurations of simultaneously used induction heating coils can be achieved. In particular, the respective switches, for example relays, of the connecting device can advantageously be controlled individually, in order to achieve corresponding connections. The auxiliary half bridges can be controlled in particular such that they excite the resonant circuits together with the reference half bridge as a full bridge in an adequate manner. The control can also be arranged to control the reference half bridge.

The control can in particular be configured to control the auxiliary half bridges and/or the connecting device such that further induction heating coils, located underneath one single cooking vessel, are commonly connected to one single auxiliary half bridge, at least if the cooking vessel does not cover more than a predetermined maximum number of induction heating coils. This allows establishing of individual cooking zones, which can be adapted advantageously to the size of the respective cooking vessels used.

The control is further preferably configured to interconnect or excite in parallel, in fact preferably using the same power adjustment, a plurality of adjacent coils to one common cooking zone. Regrouping of cooking zones according to demand is also allowed thereby.

The output power of a heating circuit and an induction heating coil, respectively, according to the invention can be controlled in particular via frequency and via true AC control by phase shifting of the bridge voltages, in particular without asymmetrical pulse-width modulation.

The full bridge technology allows, as compared to the half-bridge technology, in particular smaller resonant circuit currents with comparable output power. Thereby, the losses in the power semiconductors are reduced, there is improved distribution of losses, increased service life, smaller and more favorable power semiconductors can be employed, there is less cooling input needed, smaller and/or a lesser number of and more favorable resonant circuit capacitors can be used, and smaller and more favorable relays can be used.

For a possible symmetrical control of the half bridges using a duty cycle of 50%, there are typically no semiconductor bridge drivers required.

These and further features arise not only from the claims but also from the description and the drawings, wherein the individual features are each implemented individually or together in the form of secondary combinations in one embodiment of the invention and in other fields and can represent advantageous embodiments for which protection can be obtained per se and for which protection is claimed here. The division of the application into individual sections and intermediate headings does not limit the general applicability of the statements made under the headings.

BRIEF DESCRIPTION OF THE SEVERAL VIEWS OF THE DRAWINGS

The exemplary embodiments of the invention are illustrated schematically in the drawings and are explained in more detail below. In the drawings.

DETAILED DESCRIPTION

Figure 1:
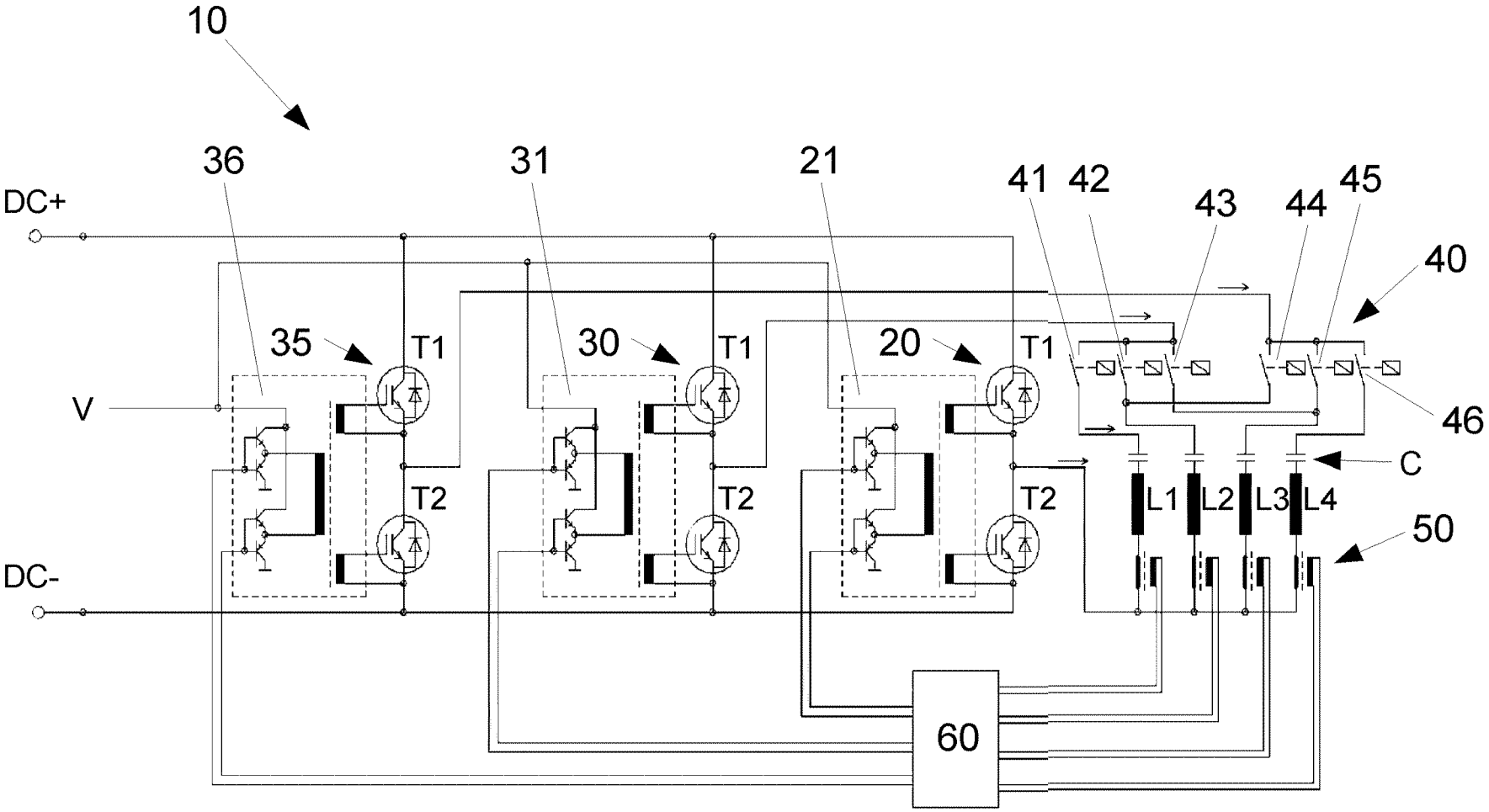
FIG. 1 shows a heating circuit.

FIG. 1 shows a heating circuit 10 for induction heating coils. The heating circuit 10 has a positive supply input DC+ and a negative supply input DC−, to which a supply voltage for supplying half and full bridges, respectively, can be applied. Furthermore, the circuit includes an additional supply voltage input V, to which an additional supply voltage for supplying magnetic transformers is to be applied.

The heating circuit 10 has a total of four induction heating coils L1, L2, L3, L4 which, in general, are arranged to heat a cooking vessel placed onto a cooktop hotplate (not illustrated) by induction. Each induction heating coil L1, L2, L3, L4 has a respective capacitor assigned, wherein the capacitors are in summary indicated by reference letter C. A respective induction heating coil L1, L2, L3, L4 forms a respective series resonant circuit together with the respective capacitor C thereof.

For exciting the resonant circuits the heating circuit 10 has a reference half bridge 20 and a first auxiliary half bridge 30 and a second auxiliary half bridge 35. The reference half bridge 20 has a first magnetic transformer 21 assigned. The first auxiliary half bridge 30 has a second magnetic transformer 31 assigned. The second auxiliary half bridge 35 has a third magnetic transformer 36 assigned. The magnetic transformers 21, 31, 36 are for controlling the respective half bridges 20, 30, 35.

Each half bridge 20, 30, 35 includes a respective first transistor T1 and a respective second transistor T2. The functional operation of such half bridges is well-known per se, and therefore, there will be no further detailed explanation given.

As is apparent from FIG. 1, a respective terminal in a bottom position of a respective resonant circuit is connected to the reference half bridge 20. On the top side, the respective resonant circuits are connected to a switchable connecting device 40. The connecting device 40 includes a first switch 41, a second switch 42, a third switch 43, a fourth switch 44, a fifth switch 45 and a sixth switch 46.

As is apparent from FIG. 1, the resonant circuit located furthermost to the left, which includes the first induction heating coil L1, and the resonant circuit located furthermost to the right, which includes the fourth induction heating coil L4, are connected to the first switch 41 and to the sixth switch 46, respectively. The switches 41, 46 are each connected only to one auxiliary half bridge 30, 35. Thus, the resonant circuits located at the outer side can merely be connected to a respective auxiliary half bridge 30, 35, or instead be disconnected therefrom. In contrast, the two resonant circuits located at the inner side, wherein the other two induction heating coils L2, L3 are located, are connected to the second, third, fourth and fifth switches 42, 43, 44, 45 in such a manner that both these resonant circuits can be connected selectively to both the auxiliary half bridges 30, 35, or not be connected thereto. What possible wiring connections may result from the embodiment, will be described and demonstrated in more detail further below with reference to FIG. 2. In particular the wiring connections together with the use of four induction heating coils L1, L2, L3, and L4 have proved to be advantageous. This applies in particular for the use of a typical, 16 A fused, domestic mains connection, since with the four induction heating coils L1, L2, L3, L4, there is an optimum utilization of the supplied power obtained.

The heating circuit 10 further includes a total number of four current converters 50, wherein each current converter 50 is assigned to one of the four resonant circuits. By means of the respective current converter 50, a current flowing through the respective induction heating coil L1, L2, L3, L4 can be measured.

The heating circuit 10 further includes an electronic control 60 which in the present case is in the form of a microcontroller. The control 60 is connected to each of the magnetic transformers 21, 31, 36, as shown, and is arranged to control the magnetic transformers 21, 31, 36 and, thereby, also to control the respective half bridges 20, 30, 35. In other words, the control 60 can provide for the feature that respective transistors T1 or T2 are switched to be conducting or non-conducting and, thus, control of a resonant circuit respectively connected to the respective half bridge or even of a plurality of resonant circuits is obtained.

In this context, control is in a manner that two respective half bridges 20, 30, 35 connected to a resonant circuit together form a full bridge and the respective resonant circuit, thus, is excited by a full bridge. As a result, power losses can be reduced considerably.

The control 60 is connected to the connecting device 40 and can switch each of the switches 41, 42, 43, 44, 45, 46 individually. Thus, any arbitrary configuration of switched connections can be set within the scope of the predetermined possibilities. This will be discussed in more detail further below with reference to FIG. 2.

The current converters 50 are connected to the control 60, as shown, such that the control 60 obtains feedback on a respective current flowing through a resonant circuit and, thus, also on the respective power. This allows an exact power control and power regulation, respectively, of the resonant circuits.

It should be understood that any details apparent in FIG. 1 can be of essential importance for the invention and can be used to distinguish the invention and the claims from the prior art.

Figure 2:
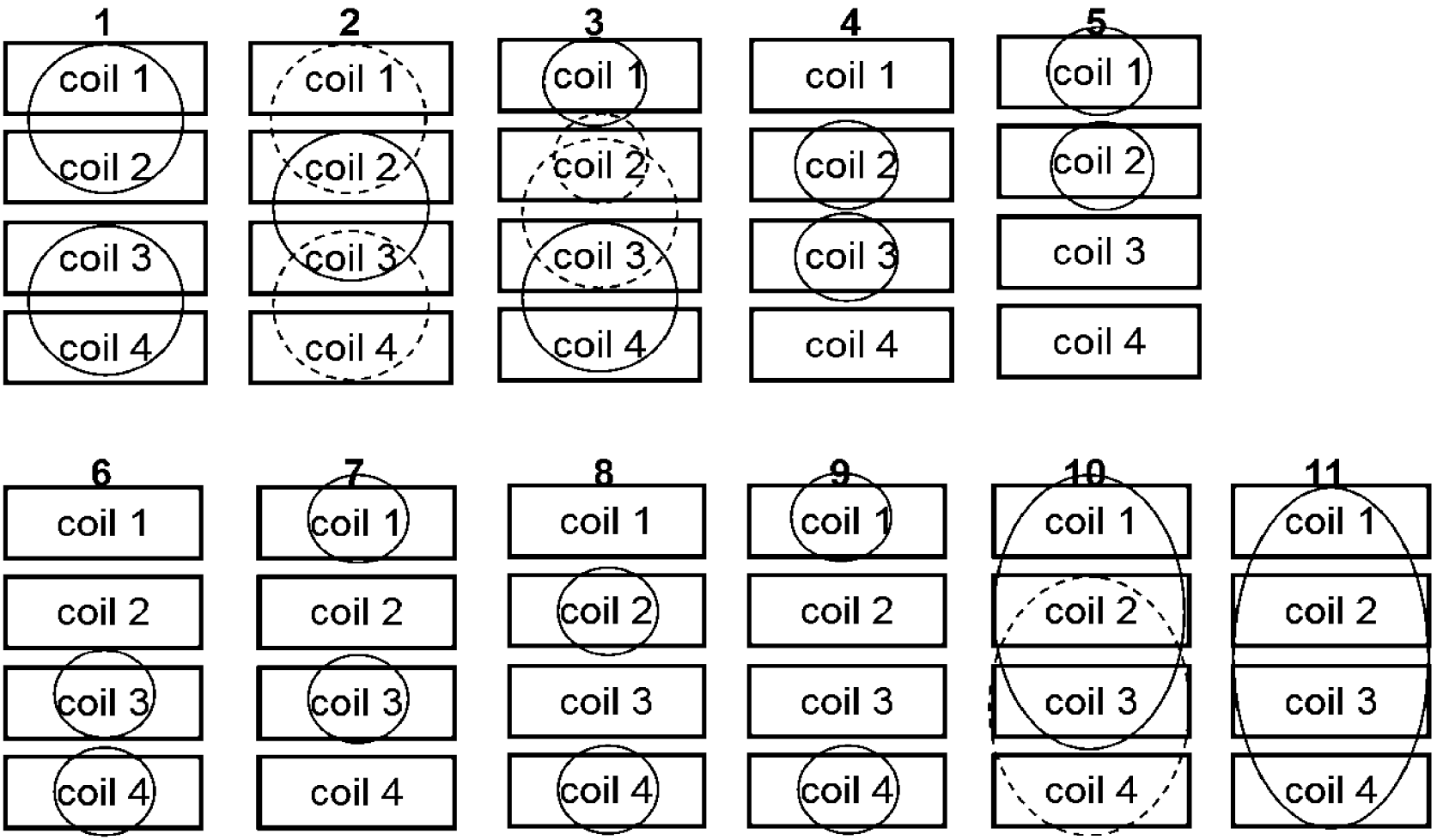
FIG. 2 shows possible control profiles.

FIG. 2 shows a number of different configurations of cooking zones, which can be adjusted by means of the heating circuit 10 according to FIG. 1. In particular the connecting device 40 can be adjusted in a way that such configurations are produced. A total of eleven fields are illustrated in FIG. 2, wherein one or more possible configurations are illustrated in each of them. The configurations are each illustrated by a continuous line or even with a dashed line. The induction heating coils L1, L2, L3, L4 are indicated therein by the reference sign "coil 1", "coil 2", "coil 3", and "coil 4".

In the first field of FIG. 2, the first and second induction heating coils L1, L2 and the third and fourth induction heating coils L3, L4 are interconnected to respective cooking zones. In the second field, in each case two adjacent induction heating coils, that is, L1 and L2, L2 and L3, or L3 and L4, are interconnected to a respective cooking zone. In the third field, two adjacent induction heating coils are interconnected to one cooking zone, wherein simultaneously one further induction heating coil is operated as a single cooking zone. In the fourth field, the second and third induction heating coils L2, L3 are each connected as independent cooking zones.

In the fifth to ninth field, likewise in each case two induction heating coils are each connected as an independent cooking zone. In the tenth field, three juxtaposed induction heating coils, that is, L1, L2 and L3, or instead L2, L3 and L4 are interconnected to one cooking zone. In the eleventh field, all of the four induction heating coils L1, L2, L3, L4 are interconnected to one cooking zone.

A respective cooking zone is excited in particular by at least one common auxiliary half bridge 30, 35 together with the reference half bridge 20. Thus, there is also common control of the power of all the induction heating coils interconnected to one respective cooking zone.

The FIGS. 3 to 7 show the time curve of voltages on the half bridges 20, 30, 35 and on a resonant circuit at different controlled activations, wherein a voltage connection of 230 VAC, that is, 230 V effective voltage with alternating current, is assumed. Therein, the curve UA indicates the voltage of the first auxiliary half bridge 30, the curve UB indicates the voltage of the second auxiliary half bridge 35, the curve URef indicates the voltage of the reference half bridge 20, and the curve US indicates the voltage over a resonant circuit which is connected between the first auxiliary half bridge 30 and the reference half bridge 20. On the horizontal axis the time is indicated in each case.

As is apparent, in particular different power levels can be adjusted by means of the different controlled activations.

Figure 3:
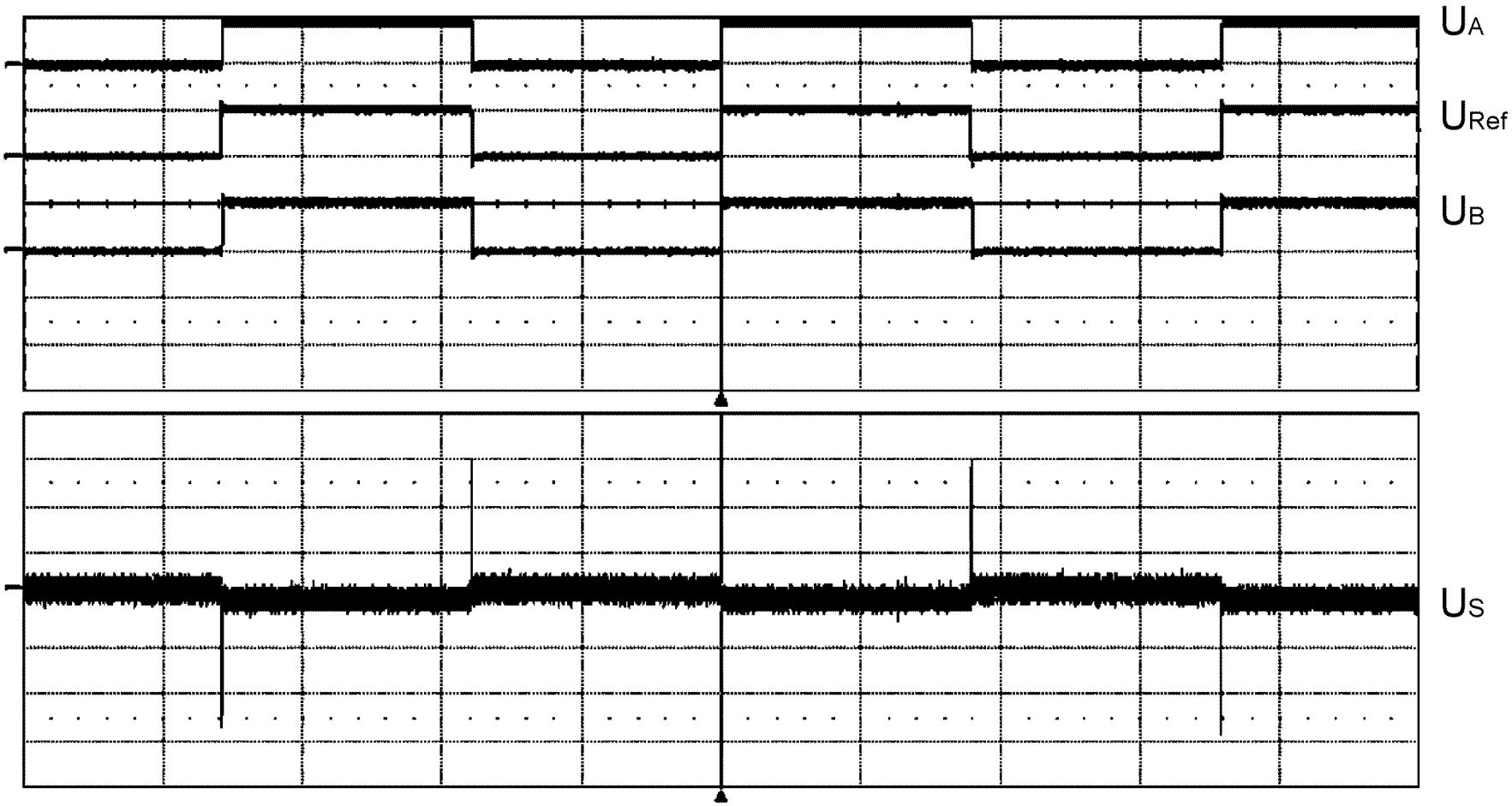
FIGS. 3 to 7 show possible conditions during power control by phase shifting.

In the condition as illustrated in FIG. 3, a phase angle of 0° is set with a frequency of 28 kHz. As a result, a voltage US is obtained at the resonant circuit, which amounts almost constantly to zero. That is, the resonant circuit is not excited. Also in the conditions as illustrated in the FIGS. 4 to 6, the frequency amounts to 28 kHz.

Figure 4:
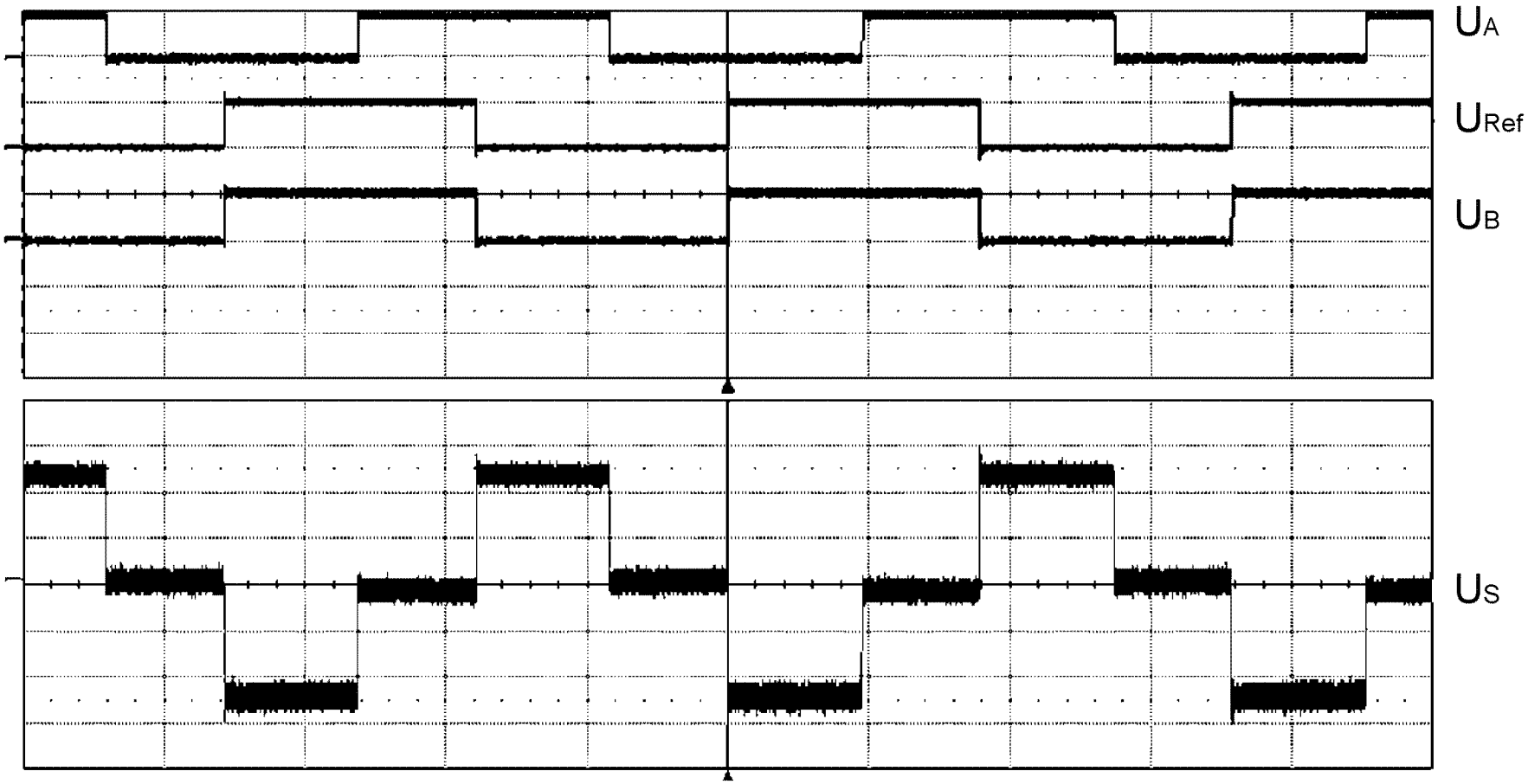

In contrast thereto, in the condition as illustrated in FIG. 4 a phase angle of 90° is set. As a result, a voltage on the resonant circuit is 115 VAC.

Figure 5:
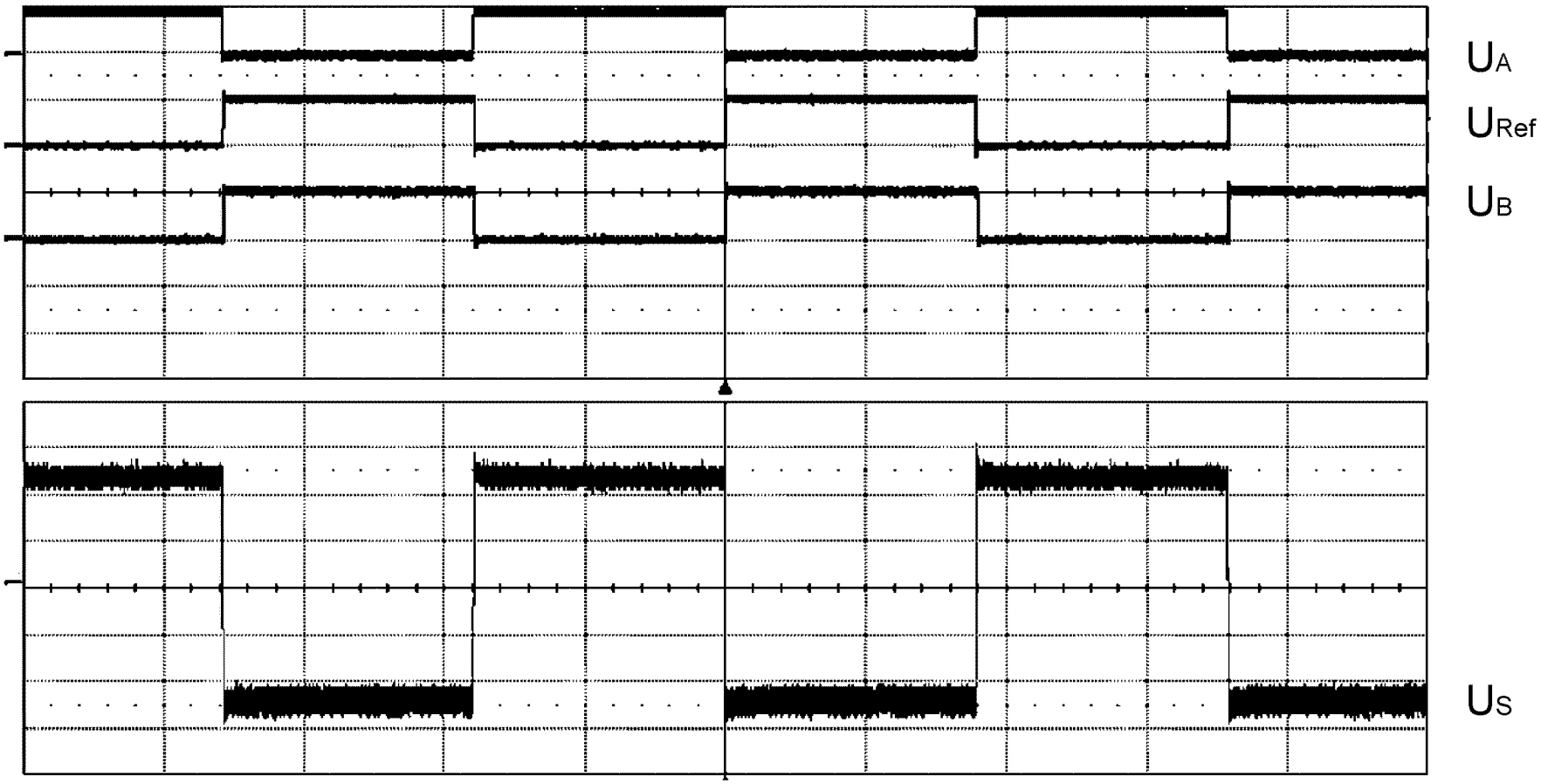

In the condition as illustrated in FIG. 5, there is a phase angle of 180° set and results to a voltage on the resonant circuit of 230 VAC.

Figure 6:
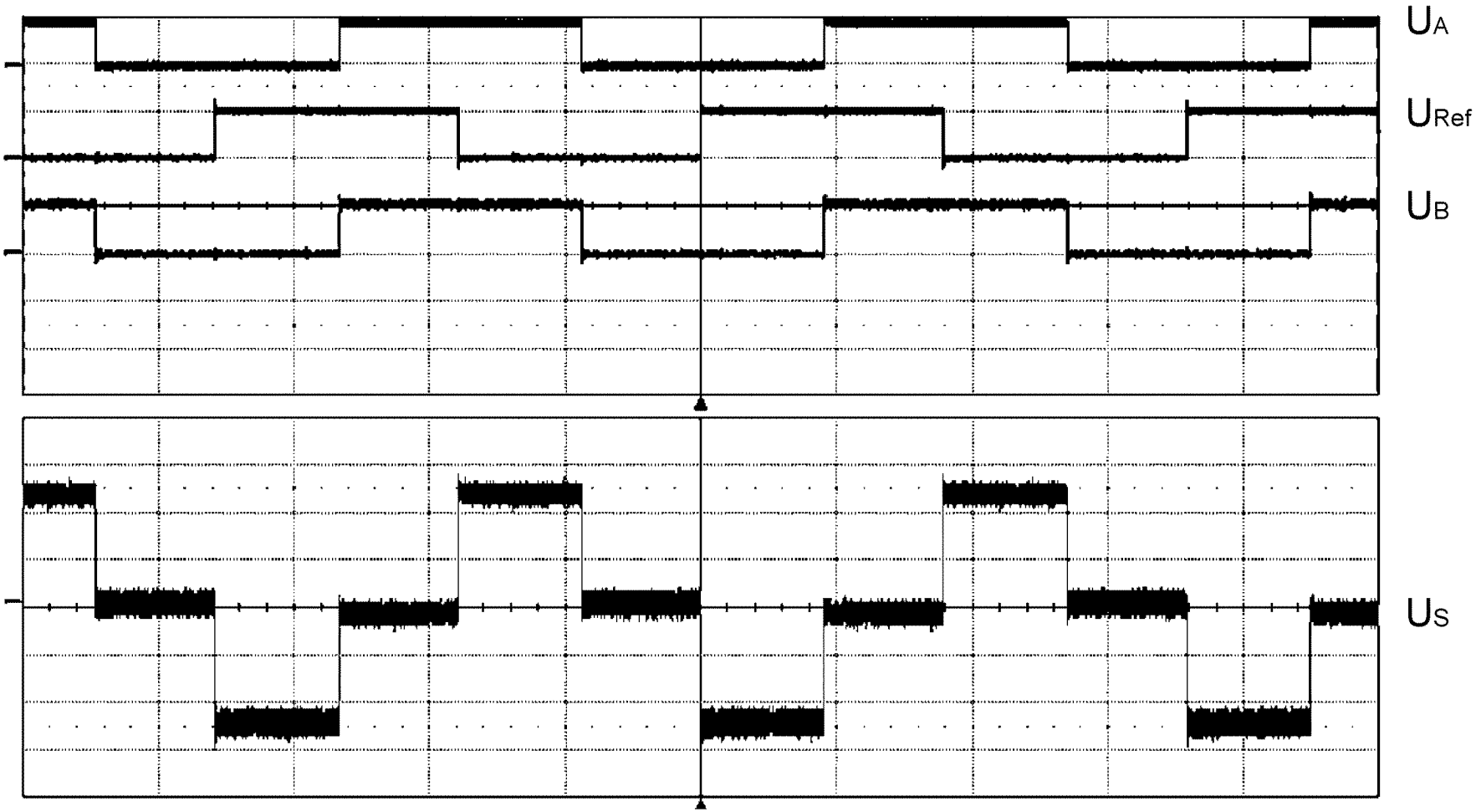

In the condition as illustrated in FIG. 6, there is a phase angle of 90° set and results to a voltage on the resonant circuit of 115 VAC and to a further voltage between the second auxiliary half bridge 35 and the reference half bridge 20 of 115 VAC. The latter differential signal is not illustrated.

Figure 7:
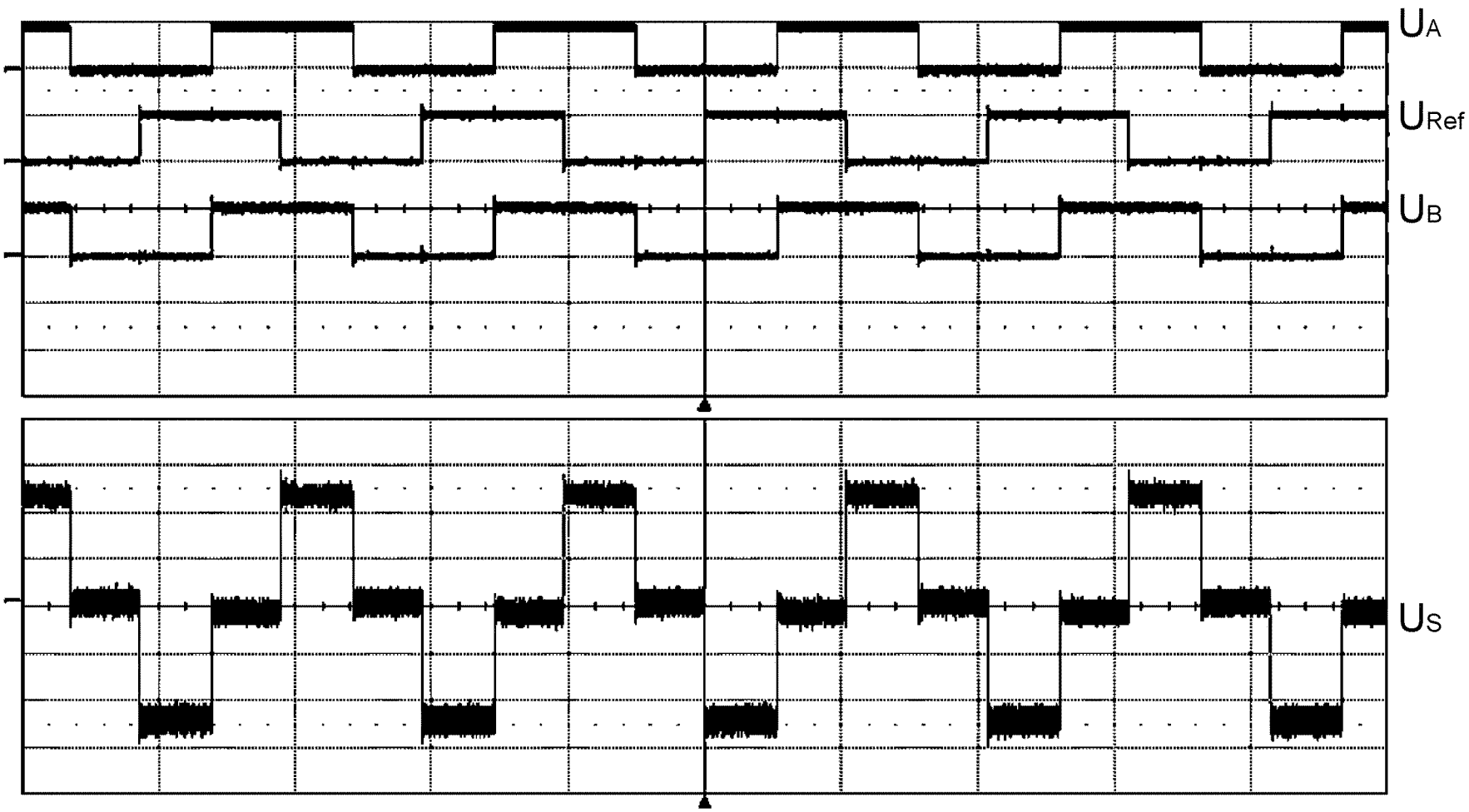

In the condition as illustrated in FIG. 7, there is a phase angle of 90° set, wherein in contrast to the aforementioned conditions according to FIGS. 3 to 6, the frequency is 48 kHz. As a result, a voltage on the resonant circuit of 115 VAC and a further voltage between the second auxiliary half bridge 35 and the reference half bridge 20 of 115 VAC are obtained. The latter differential signal is not illustrated.

In the ideal case, operation is at or close to the resonance frequency, in order to have a current as low as possible. The effective voltage or RMS voltage (that is true AC) should be kept as low as possible. Thus, losses are less, which can be one aim of the embodiment according to the invention. A further aim can be that the losses are distributed over even more power semiconductors, which leads to a minimization of thermal stress to each power semiconductor.

That which is claimed:

1. An induction cooking hob, comprising:

a cooktop hotplate; and a heating circuit for induction heating coils of the induction cooking hob, wherein the heating circuit comprises:

a reference half bridge;

at least a first and second resonant circuit, each of said at least first and second resonant circuits comprising a first terminal and a second terminal;

an induction heating coil is arranged in each of said at least first and second resonant circuit;

at least a first auxiliary half bridge and a second auxiliary half bridge; and a switchable connecting device, wherein:

each of said first terminals of each of said at least first and second resonant circuits is coupled to said reference half bridge, each of said second terminals of each of said at least first and second resonant circuits is coupled to said switchable connecting device, said switchable connecting device comprises at least a first switch a second switch, and a third switch, said first resonant circuit is assigned to only said first switch, said first switch in a closed condition connects said first resonant circuit to only said first auxiliary half bridge and to said to reference half bridge, said second resonant circuit is assigned to only said second switch and said third switch, said second switch in a closed condition connects said second resonant circuit assigned thereto to only said first auxiliary half bridge and to said reference half bridge, said third switch in a closed condition connects said second resonant circuit assigned thereto to only said second auxiliary half bridge and to said reference half bridge, such that:

each of said at least first or second resonant circuits connected to only one of said at least first or second auxiliary half bridges is excitable by a full bridge composed of said at least first or second auxiliary half bridge and said reference half bridge, and each of said at least first and second resonant circuits of said heating circuit comprises one respective induction heating coil which is arranged underneath said cooktop hotplate for establishing a cooking zone.

2. The induction cooking hob according to claim 1, wherein each of said at least first and second switches are relays.

3. The induction cooking hob according to claim 1, wherein each of said at least first and second resonant circuits are series resonant circuits.

4. The induction cooking hob according to claim 1, wherein each of said at least first and second auxiliary half bridges comprises an assigned magnetic transformer for control.

5. The induction cooking hob according to claim 1, wherein each of said induction heating coils are of identical design.

6. The induction cooking hob according to claim 5, wherein each of said at least first and second auxiliary half bridges are of identical design.

7. The induction cooking hob according to claim 1, wherein each of said induction heating coils comprises an assigned current converter for measuring and regulating, respectively, of a power of each of said induction heating coils.

8. The induction cooking hob according to claim 1, wherein said heating circuit is arranged to perform power adjustment by phase shifting of bridge voltages.

9. The induction cooking hob according to claim 1, wherein said switchable connecting device fixedly connects each of said at least first and second resonant circuit to only one of said at least first or second auxiliary half bridges and to said reference half bridge.

10. The induction cooking hob according to claim 1, wherein:

a control arranged to control each of said at least first and second auxiliary half bridges and/or said switchable connecting device is provided; and said control is configured to detect one or more saucepans on said cooking plate and to control each of said at least first and second auxiliary half bridges and/or said switchable connecting device such that each of said respective induction heating coils, which are completely or partially covered by a cooking vessel, are excited.

11. The induction cooking hob according to claim 10, wherein:

said control is configured to control each of said at least first and second auxiliary half bridges and/or said switchable connecting device such that further each of said induction heating coils, located underneath one single cooking vessel, are commonly connected to only one of said at least first or second auxiliary half bridges and to said reference half bridge, at least if said cooking vessel does not cover more than a predetermined maximum number of each of said induction heating coils.

12. The induction cooking hob according to claim 1, wherein said control is configured to interconnect or excite in parallel each of said induction heating coils to one common cooking zone.

13. The induction cooking hob according to claim 12, wherein said control is configured to interconnect or excite in parallel each of said induction heating coils to said one common cooking zone using the same power adjustment.

* * * * *